United States Patent [19]

Herbert

[11] 4,367,588

[45] Jan. 11, 1983

[54] PROCESS FOR CUTTING STRIPPABLE FILM

[76] Inventor: Thomas A. Herbert, 3044 Old Yellow Springs Rd., Fairborn, Ohio 45324

[21] Appl. No.: 50,241

[22] Filed: Jun. 20, 1979

Related U.S. Application Data

[63] Continuation-in-part of Ser. No. 909,153, May 24, 1978, abandoned.

[51] Int. Cl.[3] ..... B26D 3/08; B43L 13/00

[52] U.S. Cl. ..... 33/1 M; 33/18 R; 83/71; 83/861

[58] Field of Search ..... 33/1 M, 18 R, 27 R, 33/32 R; 30/164.9; 84/71, 861

[56] References Cited

U.S. PATENT DOCUMENTS 3,339,279 9/1967 Sovar et al. ..... 33/18 R

*Primary Examiner*—John W. Shepperd

*Attorney, Agent, or Firm*—Donald J. Singer; Casimer K. Salys

[57] ABSTRACT

A system for cutting curvilinear patterns in strippable films with a high speed computer controlled flat bed plotter having a diamond point cutter positioned in the plotting head. The scribe pressure is set between 200 and 300 grams with the plotter set to drive the plotting head at a speed between 20 and 30 inches per second and with the head acceleration set between 0.4 G's and 0.7 G's.

1 Claim, 3 Drawing Figures

PROCESS FOR CUTTING STRIPPABLE FILM

RIGHTS OF THE GOVERNMENT

The invention described herein may be manufactured and used by or for the Government of the United States for all governmental purposes without the payment of any royalty.

REFERENCE TO RELATED APPLICATIONS

This is a Continuation in Part of application "Strippable Film Cutter and Process", Ser. No. 909,153, filed May 24, 1978 now abandoned.

BACKGROUND OF THE INVENTION

In high speed flat bed plotting systems, the movement of the marking head is controlled by a computer to plot various patterns. The plotting head includes four pen holders wherein the pen pressure can be adjusted to the desired value. The computer selects orientation, acceleration, speed, pen assignment and scale factor.

These plotters have been used to cut orthogonal line patterns in strippable films. In cutting patterns in strippable films, the four pen holders are replaced with four flat chisel point cutters, set to cut in various directions. The particular blade used is selected by the computer in accordance with the direction of the cut. When the cutters were substituted for the pens, it was found necessary to operate the plotter in the speed range of between 5 and 10 inches per second.

If these flat cutters are used to cut in any direction except that for which it is set, the cutter will drag and tear the plastic film.

Point scribes have been used for some time in engraving and marking instruments. These point scribes were tried in hand operated X-Y plotters but were found to be very erratic and tended to drag and tear the film. In the past when making patterns on a strippable film, the high speed X-Y plotter has been used only for making straight line cuts. Any curvilinear designs had to be cut by tedious hand cutting techniques.

Diamond point cutters were tried by applicant in high speed flat bed plotters at normal cutting speeds, point pressures and accelerations, but were found to tear, drag and gouge out material. Ruby, sapphire and tungsten points scribes were also tried but it was found that they wear down too fast.

BRIEF SUMMARY OF THE INVENTION

According to this invention, straight line and curvilinear patterns are cut on strippable films, such as Rubylith, a registered trademark material made by Ulana Corporation, and Stabilene Film, made by Keuffel and Esser Company. A diamond point cutter has been adapted for use in a standard high speed X-Y plotter such as the Xynetics 1100 plotting system with the HP 2100 Computer and teletype control. It has been found that the strippable film can be cut with a diamond point cutter, without tearing, dragging and gouging when the scribe pressure is set between 200 and 300 grams and when the computer is set to drive the plotting head at between 20 and 30 inches per second and when the head acceleration is set between 0.4 and 0.7 G's.

IN THE DRAWING

DETAILED DESCRIPTION OF THE INVENTION

Figure 1:
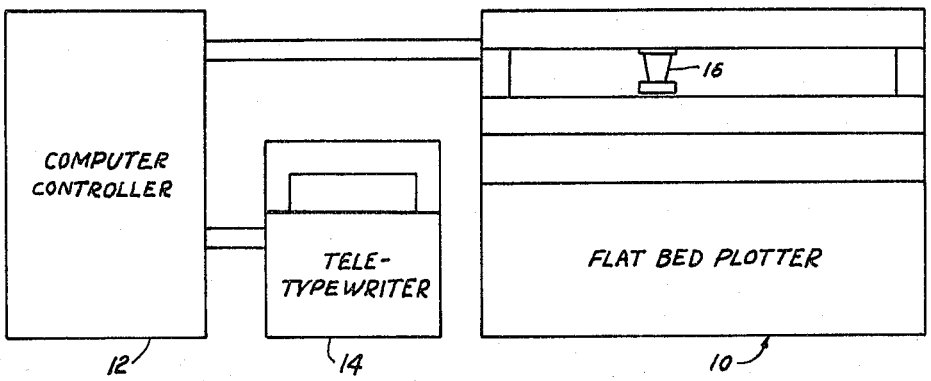
FIG. 1 is a schematic block diagram of a conventional computer controlled flat bed plotter.

Reference is now made to FIG. 1 of the drawing which shows a conventional flat bed plotter 10 which is capable of plotting various patterns under the control of computer controller 12 which is operated in conjunction with a conventional teletypewriter controller 14, to control the movement of plotting head 16, which holds four plotting pens, not shown in this figure.

Figure 2:
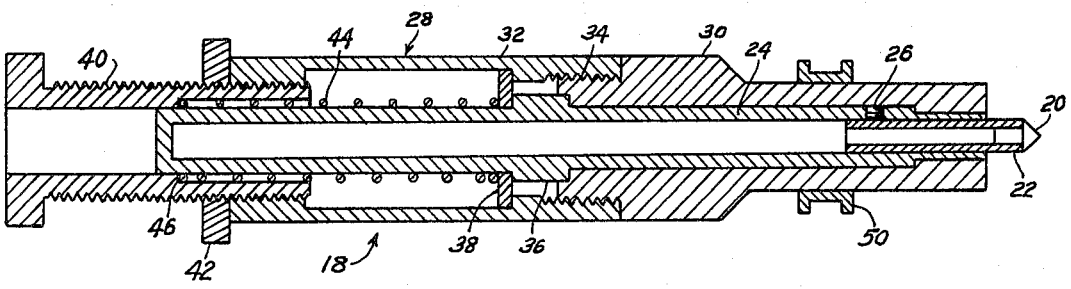
FIG. 2 shows a modified flat bed plotter pen holder according to the invention.

A modified pen holder 18 for use with the device of FIG. 1 as shown in FIG. 2 is adapted to hold a diamond point cutter 20. The diamond point cutter 20 is secured to point holder 22 in a conventional manner, such as with an adhesive. The point holder 22 is held in a support tube 24 by means of a set screw 26. The support tube 24 is held within an outer housing member 28 which includes two separable sections 30 and 32 threaded together at 34.

A circumferential projection 36 on support tube 24 engages an annular member 38. An adjustable member 40 is threaded into member 32 and is held by lock nut 42. A spring member 44 surrounds support tube 24 and engages member 38 and a shoulder 46 in member 40. The member 38 has flat sides, not shown, to permit insertion into member 32. Adjustment of member 40 sets the pressure on the diamond point cutter 20. This pressure is measured with a beam scale. For cutting curvilinear patterns in strippable film, the pressure should be set between 200 and 300 grams.

Figure 3:
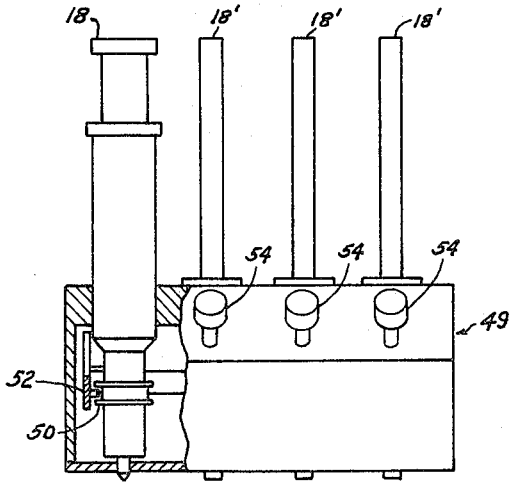
FIG. 3 shows the pen holder of FIG. 2 positioned in a plotting head such as used with the device of FIG. 1.

The pen holder 18 is positioned in the plotting head pen mounting member 49 in a conventional manner, as shown in FIG. 3. An operating ring member 50 is secured to member 30 and engages operating lever 52 in a conventional manner. The lever 52 is controlled by a solenoid, not shown, in the plotting head to raise and lower the pen holders. An adjustment screw, not shown, similar to adjustment screws 54 for pen holders 18' is used to adjust the stop position for pen holder 18. Screws 54 engage an arm, not shown, on operating levers 52.

Flat bed plotters are available with head speeds up to 40 inches per second with accelerations up to 1 G.

For cutting strippable film with a diamond point cutter, the head speed is set between 20 and 30 inches per second with the acceleration set between 0.4 and 0.7 times the acceleration of gravity, G.

There is thus provided an apparatus and process for cutting curvilinear patterns in strippable films on a flat bed plotter without dragging and tearing the film.

I claim:

1. The process of cutting curvilinear patterns in the plastic layer on a strippable material with a computer controlled X-Y flat bed plotter wherein the computer is programmed to move the plotting head over the strippable material with desired pattern, comprising: placing the diamond point cutter in the plotting head of the flat bed plotter; adjusting the scribe pressure on said diamond point cutter to between 200 and 300 grams; moving the plotter head over the strippable material in response to the computer command at a head speed of between 20 and 30 inches per second with a plotter head acceleration between 0.4 G and 0.7 G.

* * * * *